US005430261A

United States Patent [19]

Malone

[11] Patent Number: 5,430,261

[45] Date of Patent: Jul. 4, 1995

[54] SWITCH ASSEMBLY INCLUDING SEQUENTIAL SWITCH ROCKER/LEVER OPERATING MECHANISM

[75] Inventor: Peter G. Malone, Park Ridge, Ill.

[73] Assignee: Eaton Corporation, Cleveland, Ohio

[21] Appl. No.: 182,929

[22] Filed: Jan. 18, 1994

[51] Int. Cl.[6] ..... H01H 9/00; H01H 13/00

[52] U.S. Cl. ..... 200/1 B; 200/5 R; 200/339; 250/227.22

[58] Field of Search ..... 200/1 B, 5 R, 5 A, 512, 200/517, 314, 339, 553, 557; 250/227.11-227.22, 229

[56] References Cited

U.S. PATENT DOCUMENTS

| | | | |
|---|---|---|---|
| 4,480,182 | 10/1984 | Ely et al. | 250/227 |
| 4,668,843 | 5/1987 | Watanabe et al. | 200/5 A |
| 4,856,785 | 8/1989 | Lantz et al. | 250/221 X |
| 4,967,043 | 10/1990 | Killarney | 200/1 B |
| 5,090,791 | 2/1992 | Kidder et al. | 250/227.22 X |
| 5,115,108 | 5/1992 | Ogawa et al. | 200/1 B |
| 5,239,119 | 7/1994 | Swartz et al. | 250/229 |

*Primary Examiner*—J. R. Scott

*Attorney, Agent, or Firm*—Roger A. Johnston

[57] ABSTRACT

A switch assembly having a rocker type actuator user rotatable for sequentially actuating plural switches. The rocker contacts, off center a lever beam supported at its end by plungers disposed to actuate the individual membrane switches or optical activators. User applications of an initial force to the rocker causes the lever beam to pivot about the remote plunger for actuation of the switch closest to the rocker contact point. After actuation of the closest switch, user application of a greater force continues rotation of the rocker to cause the lever beam to pivot about the closest plunger for causing actuation of the remote switch. Overtravel is shared by beam deflection of the lever and columnar compression of cylindrical tower portions of the resilient membranes.

10 Claims, 3 Drawing Sheets

SWITCH ASSEMBLY INCLUDING SEQUENTIAL SWITCH ROCKER/LEVER OPERATING MECHANISM

BACKGROUND OF THE INVENTION

The present invention relates to switches and particularly switches of the type having a pivotally mounted actuator or rocker member rotatable by the user in a clockwise and anti-clockwise direction for actuation of selected switching mechanisms to control a desired circuit function. Switches actuated by a rocker member have found particularly widespread usage in automotive applications for user remote control of various vehicle accessories such as window lift motors, door lock solenoids and mirror adjustment motors. Typically, such automotive switch applications operate at a low direct current voltage such as twelve volts; and have been required to switch substantial currents on the order of ten to twenty amperes direct current at twelve volts for providing the control of the accessory motor in such automotive vehicle accessory motor remote control applications, it has been commonplace to employ snap acting switches for switching the motor load current. Snap acting switch mechanisms have inherently provided internal spring biasing which must be overcome to effect switch actuation and have thus provided a tactilely discernable feedback to the user of the switch actuation.

However, in switching applications where low current loads are to be remotely controlled as for example in circuit systems where only fractional or milliampere signal currents are to be switched, it has been found unnecessary to utilize a snap acting switch mechanism; thus, the complexity and cost of the snap acting mechanism may be eliminated. Where such low current switches are employed, it has been found that there is no inherent tactilely discernable force feedback to the user indicating the state of actuation of the switching mechanism. Thus, in automotive applications where the user is accustomed to rocker type switch actuation with tactilely discernable indication of the state of switch actuation, it has been desired to emulate the switch actuation characteristics of the snap acting switching mechanism yet to provide such actuation in a low cost switching mechanism employing direct movement of the contacts without the inherent spring forces associated with a snap acting mechanism.

In certain switch applications, it has been desired to provide sequential actuation of plural switches by user movement of the actuation rocker member in one direction. This type of sequential plural switch actuation has been employed in automotive applications where it was desired to provide an "express" or automatic down or lowering function for powered window motors to permit user relaxation of the switch rocker yet provide continuous downward movement of the window to its lower opening limit. Upon user movement of the switch rocker actuator member to a rotated position in such systems, the window motor is energized to lower the window; and, so long as the user maintains the rocker in that position the motor will continue running. However, if the user rotates the rocker further beyond the motor actuation position, to a second tactilely discernable position, an electronic control circuit is energized to maintain the motor running despite subsequent user relaxation of the actuation force from the rocker and the returning of the rocker to its neutral or "off" position or allowing the rocker to self return to the neutral position. Where snap acting switches are employed for switching the powered window motor current, the inherent spring forces in the snap acting switch mechanism are readily tactilely discernable by the switch user upon movement of the rocker actuator member. However, where relays are employed which permits the use of low current switches in automotive accessory remote control applications such, as for example, powered window motor remote control, it has thus been desired to provide a way or means of providing a tactilely discernable feedback of the switch actuation without employing costly snap acting switching mechanisms.

SUMMARY OF THE INVENTION

The present invention provides a switch assembly actutated by user rotation of a rocker or actuating member in opposite directions about a pivot. In at least one direction of movement the rocker member is effective to sequentially actuate a plurality of switches. A first and second switch are mounted on a common side of the rocker pivot and each is disposed for actuation by a plunger member slidably mounted on the housing. A lever member ~~is~~ disposed with opposite ends supported by the plungers. The switches are biased to the open condition; and, where membrane type switches are employed, by the resiliency of the membrane. Upon application by the user of an initial force and movement of the rocker in one direction, the rocker contacts the lever intermediate the midpoint and one end and overcomes the bias of one of the switches to effect actuation thereof. Upon subsequent application of a force tactilely discernible greater than the initial force, further movement of the rocker member in the same direction occurs; and, the lever is pivoted about the plunger of the actuated switch to effect actuation of the other switch.

Rotation of the rocker member in the opposite direction through the neutral position provides actuation of a third switch. The switch mechanism of the present invention has found particular application in switches of the type having contacts mounted on resilient elastomeric domes or membranes for actuation by the individual sliding plungers.

DETAILED DESCRIPTION

Figure 1:
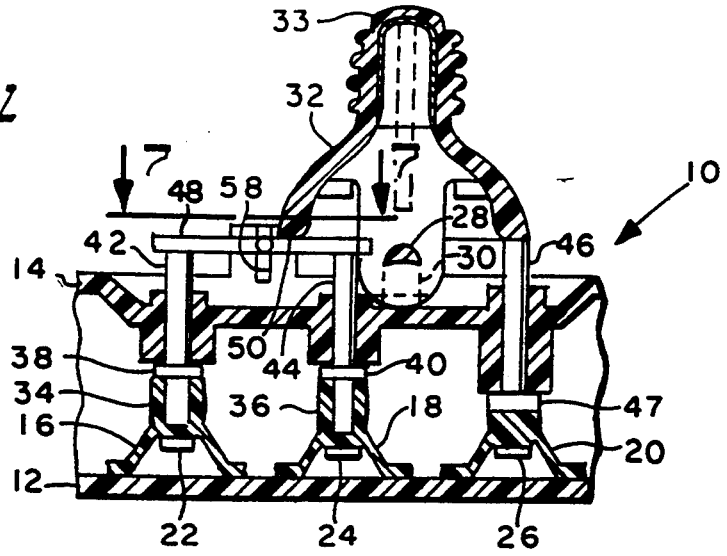
FIG. 1 is a portion of a cross-sectional view of the assembly of the present invention showing the rocker in the neutral or unactuated position.

Referring to FIG. 1, the switch assembly of the present invention is indicated generally at 10 and has a housing means comprising a cover member 14 and base 12 preferably formed of suitable insulating material such as plastic. The base has a plurality of elastomeric membranes or domes provided thereon in spaced relationship as indicated by referenced numerals 16, 18, 20 which are preferably formed of elastomeric material with each membrane, having a conductive electrical contact or pad on the underside thereof as denoted by referenced numerals 22, 24, 26. The switch membranes 16, 18 are located on a common side of a pivot surface 28. In the presently preferred practice, the pivot surface 28 is provided on an upstanding lug or stanchion 30 formed integrally with cover 14 and upon which is pivotally mounted a rocker member 32 which has a paddle portion 34 extending outwardly of the cover 14. It will be understood however that other arrangements of the pivot surface may be employed.

Membranes 16, 18 have cylindrical tower portions, denoted by reference numerals 34, 36 respectively, provided in the center thereof adjacent the contacts 22, 24 which tower portions are each preferably formed integrally with the respective membrane 16, 18. Each of the cylindrical tower portions 34, 36 is contacted respectively by a head portion, denoted respectively by referenced numeral 38, 40, of a plunger, denoted respectively 42, 44, slidably mounted in the cover 14 and with portions thereof extending upwardly and outwardly of the cover. A third plunger 46 is slidably disposed in a similarly manner on the opposite side of the pivot 28 from plungers 42, 44 and has its head portion 47 positioned for contacting membrane 26 at its center.

Figure 7:
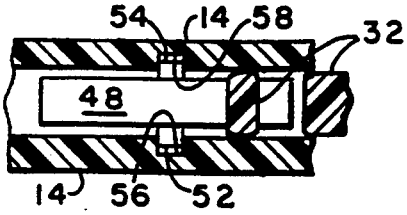
FIG. 7 is a portion of a section's view taken along section-indicating lines 7—7 of FIG. 1.

Referring to FIGS. 1 and 7, a lever means in the form of beam member 48 is disposed between the plungers 42, 44 and supported at its opposite ends by the upper ends of the plungers 42, 44. The upper surface of the beam 48 is contacted by a pivot surface 50 defined on the left hand side of rocker 32 which contacts the beam 48 at a point intermediate to mid-length and the right hand end thereof. It will be understood that by changing the point of contacts of rocker surface 50 along beam 48 that different actuating forces can be applied to the domes 16, 18.

With reference to FIG. 7, the beam 48 preferably has a pair of oppositely extending trunnions 52, 54 provided centrally thereon which engage slots 56, 58 formed in the sides of the cover 14; and, the trunnions 52, 54 are guided for vertical sliding movement in the slots 56, 58, it will be understood that trunnions 52, 54 are also free to pivot in the slots 56, 58. Although trunnions have been shown and described as a means for pivoting the lever it will be understood that other techniques may be employed for pivoting the lever.

Referring to FIG. 1, the rocker 32 is shown in the neutral or unactuated position with the switch membranes or domes 16, 18 fully extended in an upward direction with the contacts 22, 24 raised or spaced from the base 12 to provide an open circuit condition for their respective stationary contacts located thereunder (not shown) on the base 12. It will be understood that the base 12 contains a printed circuit (not shown) on the upper surface thereof with a pair of spaced contacts below each of the movable contacts 22, 24 for providing an electrical switching function wherein contacts 22, 24 act as shorting bars as is well known in the art; and, details thereof have been omitted for the sake of brevity.

In the unactuated or neutral position of the rocker shown in FIG. 1, the plungers 42, 44 are in their limit of upward movement with beam 48 having its trunnions 52,54 raised in the slots as illustrated for the slot 58.

Figure 2:
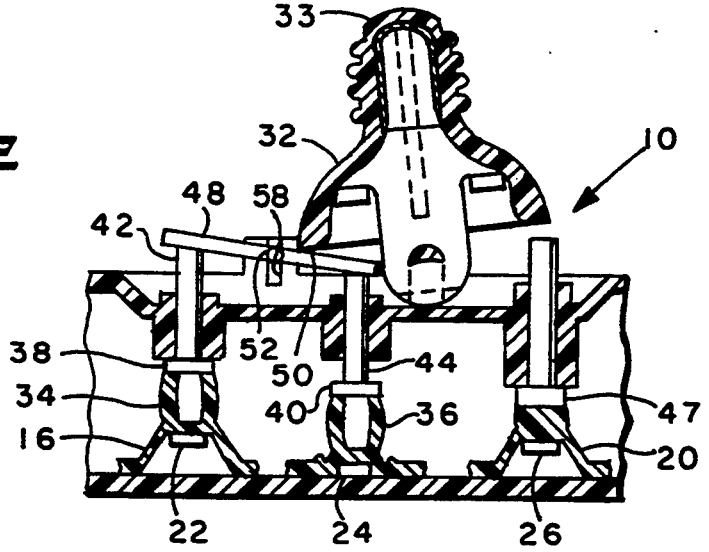
FIG. 2 is a view similar to FIG. 1 showing the rocker rotated anti-clockwise an amount actuating one of the switches.

Referring to FIG. 2, rocker member 32 has been rotated in the anti-clockwise direction by user application of an initial force on the right side of paddle 33 which initial force is sufficient to cause the trunnions 52,54 to slide initially downwardly in slots 56,58 from the position shown in FIG. 1 to the position shown in FIG. 2 and to cause beam 48 to pivot about the end of plunger 42 pushing plunger 44 and head 40 downwardly against the cylindrical portion 36 of membrane 18 and causing the membrane 18 to collapse and permit contact 24 to act as a shorting bar and close a circuit between a pair of contacts (not shown) on the base 12.

Figure 3:
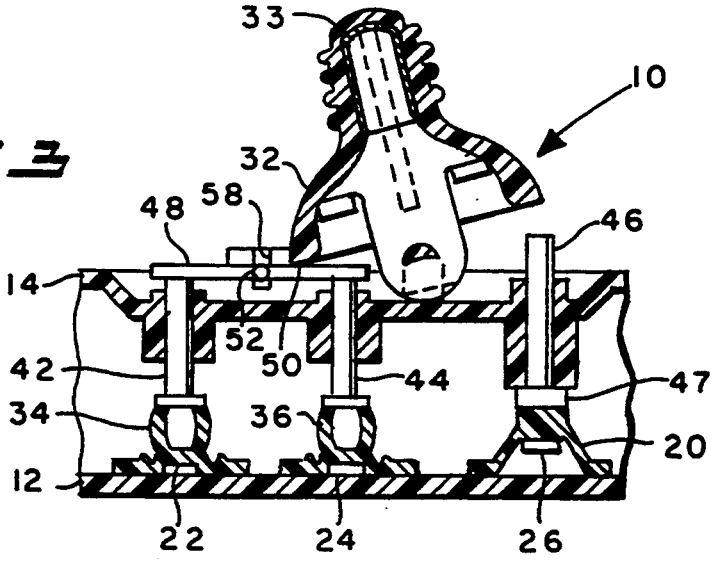
FIG. 3 is a view similar to FIG. 2 showing the rocker rotated an additional amount from the position of FIG. 2 sufficient to actuate the second switch.

Referring to FIG. 3, the rocker member 32 has been rotated further in the anti-clockwise direction from the position shown in FIG. 2 by user application of a force to the right hand side of paddle 33 which force is greater than the initial force so as to pivot beam 48 about the end of plunger 44. It will be understood that the surface 50 on rocker 32 acts about the fulcrum of member 48 on the end of plunger 44 at a mechanical disadvantage with respect to the reaction forces of plunger 42 and thus the greater force is required to effect pivoting of beam 48 about the end of plunger 44 than is required to cause the trunnions 52,54 to move a further distance downwardly in slots 56,58 from the position shown in FIG. 2 to the position shown in FIG. 3 and to pivot the beam 48 about the end of plunger 42 for membranes 16, 18 having the same configuration and resilient stiffness in the present practice of the invention the force required to effect movement of beam 48 about the end of plunger 44 and the foresaid further downward movement of trunnions 52,54 in slots 56,58 is on the order of two to three times greater than the initial force required to pivot beam 48 about plunger 42 and the initial downward movement of trunnions 52,54 in slots 56,58 and collapse membrane 18 for closing contact 24 against the base 12. In FIG. 3, rocker 32 is shown as having beam 48 with trunnions 52,54 moved fully downward in slots 56,58 and pivoted about the end of plunger 44 to depress plunger 42 with membrane 16 collapsed for closing contact 22 against a pair of spaced contacts (not shown) on base 12 for closing a circuit.

It will be observed in FIGS. 2 and 3 that the reaction on plunger 44 of the additional force being applied to paddle 33 and transmitted via rocker 32 and surface 50 to beam 48 causes trunnions 52,54 to move downward in slots 56,58 and beam 48 to apply a force to the cylindrical tower portion 36 of the membrane 18 sufficient to cause columnar deflection thereof; and, subsequent application of the greater force to paddle 34 and to beam 48 via surface 50 for effecting collapse of membrane 16 causes further sequential downward movement of trunnions 52,54 in slots 56,58 and causes a similar columnar deflection of tower portion 34 of the membrane 18. This columnar deflection in tower portions 36, 34 is illustrated in FIGS. 2 and 3 by a diametral bulging of the cylindrical tower portions.

Figure 4:
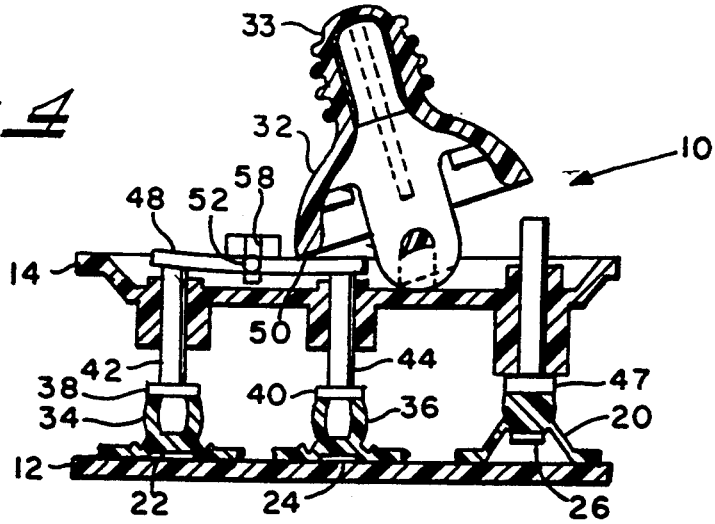
FIG. 4 is a view similar to FIG. 3 showing the actuator rocker rotated further in an anti-clockwise direction from the position of FIG. 3 to an over traveled position.

Referring to FIG. 4, the rocker 32 is shown in an overtraveled position wherein the user has applied a force greater than the initial force to paddle 33 and maintained such a greater force thereon after beam 48 has acted on plunger 42 and caused the contact 22 to collapse membrane 18. The greater force applied to beam 48 has caused beam 48 to deflect with an additional slight downward movement of trunnions 52,54 in slots 56,58 and further columnar deformation and bulging of cylindrical membrane cylindrical tower 34 and similarly by columnar compression and bulging of membrane cylindrical tower 36 by virtue of the increased Icad transmitted through plunger 44. It will be understood from FIG. 4 that overtravel of rocker 32 is partially absorbed by deflection of beam 48 and partially absorbed by the columnar deflection of membrane cylindrical towers 38, 36. It will be understood that rocker overtravel may also be accommodated by providing telescoping spring plungers and/or providing a beam spring for the lever 48.

Figure 5:
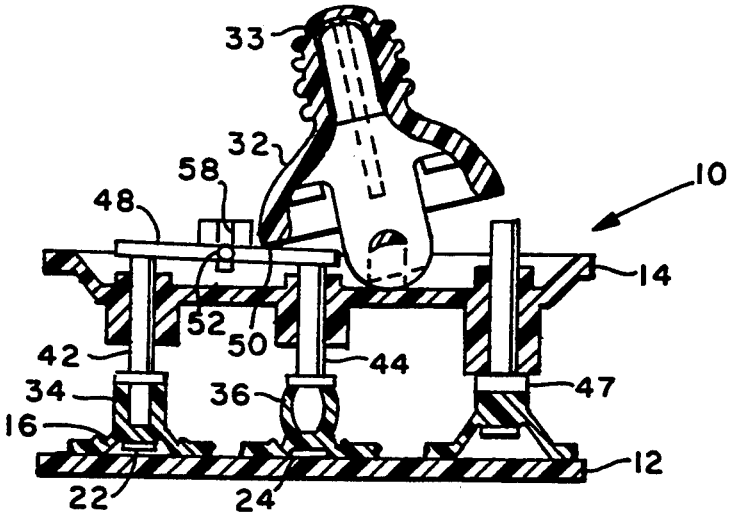
FIG. 5 is a view similar to FIG. 1 showing the rocker actuator rotated in a clockwise direction from the position of FIG. 4 to a position again as shown if FIG. 3.

Referring to FIG. 5, the rocker 32 has been moved by a slight amount in the clockwise direction from the position shown in FIG. 4 by user relaxation of the greater force applied to paddle 33. In the position shown in FIG. 5, the membrane cylindrical tower 34 has been relaxed from its bulged columnar deflection as has been beam 48, with the result that membrane 16 has raised contact 22 a slight amount so as to break the circuit from the contacts (not shown) on the base 12. The condition of the switch assembly shown in FIG. 5 would thus be considered as a circuit break or reset condition for contact 22. It will be understood that the force maintained on paddle 33 causes rocker 32 via surface 50 to maintain beam 48 pivoted about the upper end of plunger 42 and maintains plunger 44 in the downward position closing contact 24 against the base 12 and maintaining some columnar deflection and bulging in membrane cylindrical tower 36.

Figure 6:
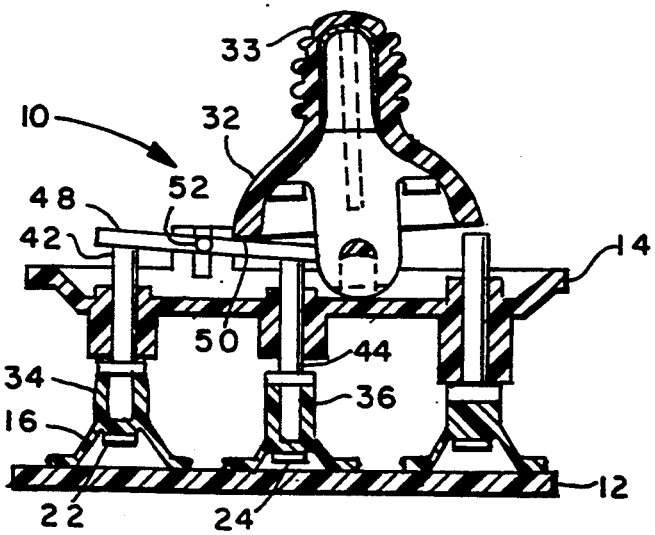
FIG. 6 is a view similar to FIG. 1 showing the actuator rotated in a clockwise direction from the position shown in FIG. 5 to a position coinciding with that of FIG. 2.

Referring to FIG. 6, the user applied force to paddle 33 has been relaxed an additional amount from that of FIG. 5 permitting rocker 32 via surface 50 to allow membrane 16 to raise to the fully extended upward position shown in FIG. 6 raising contact 22 to its upward limit of open circuit condition. The beam 48 is also pivoted about the end of plunger 42 to permit membrane tower 36 to relax from its columnar deflected and bulged condition and to permit contact 24 to raise a slight amount from base 12 thereby breaking the circuit made by contact 24. The condition of the switch in FIG. 6 is thus that of open circuit for contact 24 or reset position thereof.

Figure 8:
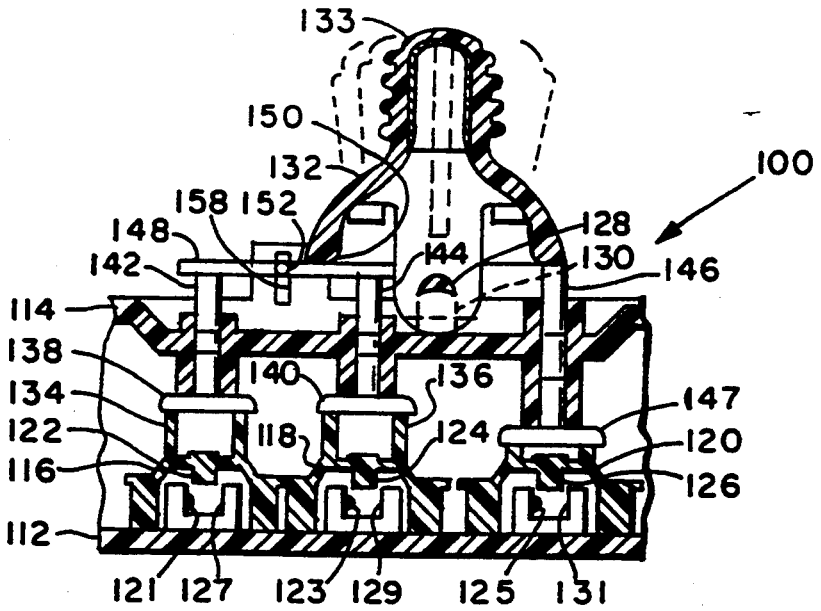
FIG. 8 is a view similar to FIG. 1 illustrating another embodiment of the invention; and, FIG. 9 is a view similar to FIG. 1 illustrating another embodiment of the invention.

Referring to FIG. 8, another embodiment of the invention is indicated generally at 100 as having a base 112 and cover 114 with three switching membranes 116,118,120 disposed in spaced relationship. Each of the membranes has a projection extending downwardly from the undersurface of the central region thereof as denoted by reference numerals 122,124,126 in FIG. 8. Each of the membranes 116,118,120 has disposed thereunder a light emitting source, for example, a light emitting diode (LED) denoted respectively by reference numerals 121,123,125 for emitting a beam of light which is detected by a suitable photo-detector disposed spaced adjacent thereto as denoted respectively by reference numerals 127,129,131.

The cover 114 has a stanchion 130 provided thereon which defines a pivot surface 128 upon which is pivotally mounted a rocker 132 which has a paddle portion 133 extending externally of the cover for user contact therewith.

Membranes 116,118 each have a cylindrical tower portion 134,136 respectively extending upwardly therefrom and which are resiliently deflectable by columnar loading thereon. The cover 114 has slidably mounted therein and positioned in alignment with the central region of each of the membranes 116,118,120 a plunger as denoted respectively by reference numerals 142,144,146. Each of the plungers has an enlarged diameter head portion provided on the lower end thereof as denoted respectively by reference numerals 138,140,147.

A lever or beam 148 is disposed between and supported at its ends by the upper ends of plungers 142,144 and is contacted on its upper surface at a desired off center position by the contact surface 150 of rocker member 132. The lever 148 is pivoted at its mid-length by any suitable expedient, as for example, oppositely disposed trunnions formed at the mid-length of the beam, one of which is shown and is denoted by reference numeral 152 in FIG. 8. The trunnions are free to slide vertically in a suitable slots one of which is shown denoted by reference numeral 158 provided in the cover. It will be understood with reference to FIG. 8 that the contact surface 150 of the rocker 132 contacts the beam 148 intermediate the trunnion 152 and the plunger 144.

It will be understood that the embodiment of FIG. 8 insofar as movement of the rocker in a counter-clockwise direction sequentially from the position shown in solid outline to the first and second positions shown in dashed outline and beam 148 against plungers 142,144 and the resilient deflection of the membranes 116, 118 is similar to that of the; embodiment of FIG. 1. However, in the embodiment of FIG. 8, when the force on the plunger heads 138,140 is sufficient to cause collapse of membrane 118 and subsequently membrane 116, the projections 124,122 are caused to move sequentially downwardly between the light emitting sources and detectors, respectively 123,129 and 121,127 for blocking light transmission therebetween and effecting a switching action. Similarly, user movement of rocker 132 in a clockwise direction from the position shown in solid outline to the position shown in dashed outline sufficient to cause depression of plunger 146 causes plunger head 147 to move membrane 120 downwardly and projection 126 blocks light transmission between source 125 and detector 131 thereby providing a light beam switching function.

The sequential switch actuation and tactilely discernible force feedback of the embodiment of FIG. 8 is otherwise similar to that of the embodiment of FIG. 1. The embodiment of FIG. 8 thus provides optical coupling or switching with the sequential actuation and tactilely discernable force feedback of the rocker and resiliently mounted lever of the present invention.

Figure 9:
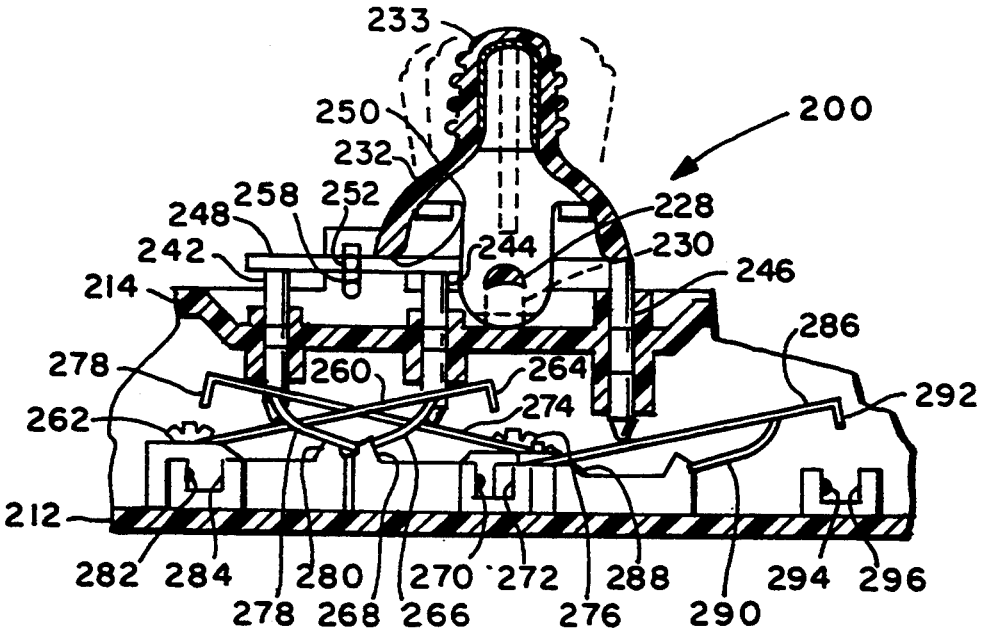

Referring to FIG. 9, another embodiment of the invention is denoted generally at 200 and includes a body or housing 212 with a cover 214 having pivotally mounted thereon at a pivot surface 228 formed on a stanchion portion 230 of the cover for pivotal movement in opposite directions by user contact with a paddle portion 233 which extends outwardly of the cover from the main portion of the rocker 232. The rocker has a contact surface portion 250 which contacts a lever 248 having pivot trunnions, one of which is shown at 252, engaging slot 258 for vertical movement therein during pivotal movement thereof. The lever 248 is supported at its ends by plungers 242,244 which are each slidably mounted in the cover 214 and which have the lower end thereof configured in a taper for contacting a precise location on a spring blade member of a switch.

Referring to FIG. 9, a resilient switch blade member 260 has one end thereof mounted on a stanchion 262 provided on the base 212 and extends generally in cantilever with the free end of the spring blade member 260 formed downwardly generally at right angles thereto. The blade member 260 is contacted by the tapered end of plunger 242 for movement thereby; and, the member 260 is also biased upwardly by one end of a spring member 266 which has the opposite reaction end thereof anchored to the base on a suitable stanchion 268. In the presently preferred practice, the spring 266 provides an over center snap action to blade member 260. A light emitting source 270 is disposed on the base and emits a beam of light which is detected by a photo-detector 272 mounted on the base and disposed adjacent thereto. The source 270 and detector 272 are located such that rotation of actuator 232 in a counter-clockwise direction to the first position shown in dashed outline will cause downward movement of the spring member 260 which will cause the end 264 thereof to interrupt the light beam from source 270 and effect an optical or light beam switching action.

Similarly a spring blade member 274 has one end thereof mounted on stanchion 276 with the free end of the member 274 formed downwardly at 278 and the member 274 biased upwardly by a spring member 278 having the opposite reaction end thereof anchored to a stanchion 280. The spring member 274 is disposed such that upon counter-clockwise rotation of the actuator 232 to the second position shown in dashed outline in FIG. 9, member 274 is caused to be moved downwardly by the tapered end of plunger 244 in a snap action; and, the free end 278 is operative to effect interruption of a light beam from a light source 282 spaced opposite from a photo-detector 284 to thereby provide a light beam switching action.

A third spring blade member 286 has one end thereof mounted on a stanchion 288 provided on the base 212; and, the spring member 286 is biased in an upward direction by a bias spring 290 which has the opposite reaction end thereof mounted on stanchion 288 with the free end of member 286 formed downwardly as denoted by reference numeral 292 for performing a switching action.

The end 292 of the member 286 is disposed such that upon clockwise rotation of actuator 232 to the position shown in dashed outline in FIG. 9 downward movement of the end 292 of switch member 286 is effected and a light beam emitting from a light emitter 294 which is interrupted from being received by a photo-detector 296 thereby performing a light beam switching function. The member 286 is disposed to be moved in a downward direction by the tapered end of plunger 246 which is slidably mounted on the opposite side of pivot 228 from the plungers 242,244.

It will be understood that the sequential counter-clockwise operation of the rocker 232 from the position shown in solid outline to the dashed outline positions effects downward movement of the trunnions such as 252 in slot 258 and pivotal movement of the lever 248 and depression of plungers 242,244 against the resiliently biased switch members 260,264 and provides a sequentially increasing force and feedback thereof to the user similar to that of the embodiments of FIGS. 1 and 8. The present invention thus provides optical switching with a tactilely discernable indication of rocker actuated switches by the user movement of the rocker actuator in one direction.

The present invention thus provides rocker actuation in one direction for sequentially actuating a plurality of low-current low-force bias switches and provides tactilely discernible force feedbacks to the user of the state of actuation of the individual switches. Movement of the rocker in an opposite direction may be employed to actuate another or third switch.

Although the invention has hereinabove been described with respect to the illustrated embodiments, it will be understood that the invention is capable of modification and variation and is limited only by the following claims.

We claim:

1. A rocker actuated switch assembly comprising:

(a) housing means;

(b) a first switch mounted on said housing means including an actuator member resiliently biased to a unactuated switch-open position and moveable to an actuated switch-closed position;

(c) a second switch mounted on said housing means spaced from said first switch and including an actuator member resiliently biased to an unactuated switch open position and moveable to an actuated switch-close position;

(d) first plunger means movably disposed on said housing means and operable upon movement to contact said first switch actuator and effect movement thereof between said unactuated and said actuated positions;

(e) second plunger movably disposed on said housing means and operable upon movement to contact said second switch actuator member and effect movement thereof between said unactuated and said actuated condition;

(f) a rocker member mounted for pivotal movement in opposite directions on said housing means;

(g) lever means supported at one end on said first plunger means and on the opposite end by said second plunger means and guided for movement in said housing means;

(h) a third switch mounted on said base means on the side of said pivotal mount opposite said first and second switch; wherein, upon user application of an initial force thereto movement of said rocker in one of said directions is effected and, said rocker contacts said lever means adjacent one of the plunger means and overcomes said resilient bias to move said first switch actuator member to the actuated position, whereupon continued user rotation of said rocker in said one direction requires a tactilely discernable force greater than said initial force and effects further movement of said lever means and overcomes the resilient bias of said other of said switch actuator members and moves said other of said switch actuator members to the actuated position; and, (i) wherein user movement of said rocker in the other of said opposite directions is operative to the effect actuation of said third switch.

2. The assembly defined in claim 1, wherein said third switch means includes a third plunger means movably mounted on said housing means and an actuator member moveable between a switch unactuated and an actuated position with said third plunger means disposed intermediate said rocker and said third switch actuator member.

3. The assembly defined in claim 1, wherein said switches include a source emitting a beam of light and a photo-detector positioned to detect the beam; and, said actuator member is operative to interrupt the beam in the actuated position.

4. A method of providing tactilely discernable sequential actuation of a pair of switches each having a resiliently biased actuator by user movement of a single rocker in one direction comprising:

(a) disposing individual plungers moveable for operatively contacting each of said switches;

(b) guiding a lever for movement on the housing and supporting the opposite ends of a lever respectively on said plungers;

(c) moving the rocker an initial amount in said one direction and contacting the lever intermediate the midpoint thereof and one of said plungers and exerting an initial force on said lever and overcoming the bias of the switch actuator adjacent said one plunger and moving said one plunger and effecting actuation of one of said switches;

(d) moving the rocker an additional amount in said one direction and applying a second force to said lever tactilely discernable to be greater than said initial force and moving the lever and plunger and overcoming the bias of the other of said switch actuators and effecting sequential actuation of the other switch of the pair.

5. The method defined in claim 4, further comprising absorbing further movement or overtravel of said rocker by resiliently deflecting said lever.

6. The method defined in claim 4, wherein said moving of said plungers includes slidably moving said plungers.

7. The method defined in claim 4, wherein said overcoming said bias includes resiliently deflecting a membrane.

8. The method defined in claim 4, wherein said overcoming said bias includes resiliently deflecting a snap acting mechanism.

9. A rocker actuated switch assembly comprising:

(a)housing means;

(b) a first switching means mounted on said housing means including an actuator resiliently biased to an unactuated first-state position and moveable to an actuated second-state position;

(c) second switching means mounted on said housing means spaced from said first switch and including an actuator member resiliently biased to an unactuated first-state position and moveable to an actuated second-state position;

(d) first plunger means movably disposed on said housing means and operable upon movement to contact said first-switching means actuator member and effect said movement between said unactuated and actuated position;

(e) second plunger means movably disposed on said housing means and operable upon movement to contact said second switching means actuator member and effect said movement between said unactuated and said actuated position;

(f) lever means guided for movement on said housing means, said lever means-supported at one end thereof by said first plunger means and at an end opposite said one end by said second plunged means;

(g) rocker means pivotally mounted on said housing means and operable upon user application of an initial force thereto in one direction to contact said lever means at a point intermediate tile mid length thereof and said one end for causing said one end to move said first plunger means and overcome said bias and effect movement of said first switching means to said actuated condition, said rocker means further operable upon user application of a second force thereto in said one direction tactilely discernible as a greater than initial force to cause movement of said opposite end of said lever means and said second plunger means and overcome said resilient bias and sequentially move said second switch means to said second state position.

10. A rocker actuated switch assembly comprising:

(a) housing means;

(b) a first switching means associated with said housing means including an actuator operable upon movement between a first position and a second position for effecting a change of state of said first switching means;

(c) a second switching means associated with said second housing means including first actuator means operable upon movement between a first position and a second position for effecting a change of state of said first switching means;

(d) an elongated lever means disposed for guided movement on said housing means, and having one end disposed for movably contacting said first actuator means and an end opposite said one end disposed for movably contacting said second actuator means;

(e) rocker means disposed for pivotal movement on said housing means and operable upon user application of an initial force thereto for movement in one direction and to contact said lever means intermediate the mid length thereof and one end and effect movement of said one end for causing movement of said first switching means actuator from said first to said second position, said rocker means further operable upon sequential user application of a second force tactilely discernible thereto in said one direction in addition to said initial force to effect movement of the end of said lever means opposite said one end and cause movement of second switching means from said first to said second state.

* * * * *